US008061810B2

(12) United States Patent
Hoisington et al.

(10) Patent No.: US 8,061,810 B2
(45) Date of Patent: Nov. 22, 2011

(54) MITIGATION OF FLUID LEAKS

(75) Inventors: Paul A. Hoisington, Hanover, NH (US); Steven H. Barss, Wilmot Flat, NH (US)

(73) Assignee: FUJIFILM Corporation, Tokyo (JP)

( * ) Notice: Subject to any disclaimer, the term of this patent is extended or adjusted under 35 U.S.C. 154(b) by 337 days.

(21) Appl. No.: 12/394,896

(22) Filed: Feb. 27, 2009

(65) Prior Publication Data

US 2010/0220143 A1 Sep. 2, 2010

(51) Int. Cl.
*B41J 2/14* (2006.01)

(52) U.S. Cl. ..... 347/47; 347/65

(58) Field of Classification Search ..... 347/47, 347/49, 64–65, 67–68; 427/466
See application file for complete search history.

(56) References Cited

U.S. PATENT DOCUMENTS 5,595,785 A * 1/1997 Hindagolla et al. ..... 430/320
5,812,158 A * 9/1998 Murthy et al. ..... 347/45
6,849,308 B1 * 2/2005 Speakman et al. ..... 427/595
7,255,428 B2 8/2007 Hara
7,357,491 B2 4/2008 Kojima
2005/0099467 A1 5/2005 Bibl et al.
2005/0243130 A1 11/2005 Essen et al.
2008/0136866 A1 6/2008 Okamura et al.

FOREIGN PATENT DOCUMENTS

WO 2009/143354 11/2009
WO 2010/051272 5/2010

* cited by examiner

*Primary Examiner* — Lamson Nguyen
(74) *Attorney, Agent, or Firm* — Fish & Richardson P.C.

(57) ABSTRACT

A fluid ejector head includes a die with a plurality of fluid ejector units, each fluid ejector unit comprising a pumping actuator having a drive electrode, and a manifold that contacts the first side of the die to define a module volume in fluidic communication with a drainage volume. The module volume is defined in part between the manifold and at least a portion of plurality of fluid ejector units, and the drainage volume is located apart from the fluid ejector units. The module volume, in comparison to the drainage volume, has a greater ratio of interior surface area to volume or has a greater percentage of interior surface area covered by a non-wetting coating.

27 Claims, 20 Drawing Sheets

MITIGATION OF FLUID LEAKS

TECHNICAL FIELD

The following description relates to methods and apparatus for mitigating fluid leakage in a fluid ejector.

BACKGROUND

A fluid ejector, for example, a printhead as employed in an ink jet printer, includes one or more fluid ejection modules, each of which includes fluid path from a fluid supply to a fluid nozzle assembly that includes nozzles from which fluid (ink) drops are ejected. Fluid drop ejection can be controlled by pressurizing fluid in the fluid path with a pumping actuator, for example, a piezoelectric deflector. Although many configurations are possible, a typical fluid ejector or printhead has a line or an array of fluid ejection modules with a corresponding array nozzles, ink paths, and associated actuators, and drop ejection from each nozzle can be independently controlled. The printhead module and the medium can be moving relative to one another during a printing operation. In a so-called "drop-on-demand" printhead module, each actuator is fired to selectively eject a drop at a specific location on a medium.

In one example, a fluid ejection module can include a semiconductor printhead body and a piezoelectric pumping actuator. The printhead body can be made of silicon etched to define pumping chambers. Nozzles can be defined by a separate substrate (i.e., a nozzle layer) that is attached to the printhead body. The piezoelectric actuator can have a layer of piezoelectric material that changes geometry, or flexes, in response to an applied voltage. Flexing of the piezoelectric layer causes a membrane to flex, where the membrane forms a wall of the pumping chamber. Flexing the membrane thereby pressurizes ink in a pumping chamber located along the ink path and ejects an ink drop from a nozzle at a nozzle velocity.

SUMMARY

This invention relates to mitigating fluid leaks in a fluid ejector.

In one aspect, a fluid ejector head includes a die with a plurality of fluid ejector units, each fluid ejector unit comprising a pumping actuator having a drive electrode, and a manifold that contacts the first side of the die to define a module volume in fluidic communication with a drainage volume. The module volume is defined in part between the manifold and at least a portion of plurality of fluid ejector units, and the drainage volume is located apart from the fluid ejector units. The module volume, in comparison to the drainage volume, has a greater ratio of interior surface area to volume or has a greater percentage of interior surface area covered by a non-wetting coating.

In another aspect, a method of diverting fluid from a fluid ejector module may include providing a die that includes a plurality of fluid ejector units, each fluid ejector unit comprising a pumping actuator having a drive electrode, providing a module volume in fluidic communication with a drainage volume, the module volume defined in part between a manifold and at least a portion of the fluid ejector modules, the drainage volume being located apart from the fluid ejector modules, providing the module volume, in comparison to the drainage volume, with a greater ratio of interior surface area to volume, or with a greater percentage of interior surface area coated by a non-wetting coating, and diverting fluid from the module volume to the drainage volume.

In another aspect, a method of making a fluid ejector head includes providing a die that includes a plurality of fluid ejector units, each fluid ejector unit comprising a pumping actuator having a drive electrode, contacting a manifold to the first surface of the die to create a module volume in fluidic communication with a drainage volume, the module volume defined in part between the manifold and at least a portion of the fluid ejector modules, the drainage volume being located apart from the fluid ejector modules, and providing the module volume, in comparison to the drainage volume, with a greater ratio of interior surface area to volume, or coating a greater percentage of interior surface area with a non-wetting coating.

Implementations may include one or more of the following features. The module volume, in comparison to the drainage volume, may have both a greater interior surface area to volume ratio and a greater percentage of interior surface area covered by the non-wetting coating. The interior surface of the module volume may be defined in part by a portion of the drive electrode or the pumping actuators. The non-wetting coating may coat the drive electrodes or the pumping actuators. The module volume may be defined by at least one dimension that is substantially smaller than each dimension of the drainage volume. The manifold may be separated from the fluid ejection modules in the module volume by between about 1 and about 20 micrometers. The non-wetting coating may coats an interior surface of the manifold at the module volume. The non-wetting coating may coats interior surfaces of the module volume and the drainage volume. The drainage volume may be substantially defined between the manifold and the first surface of the die. The first surface of the die at the drainage volume may be coated with the non-wetting coating. The drainage volume may be substantially defined within the manifold. Each pumping actuator may be a piezoelectric deflector, a thermal bubble jet generator, or an electrostatically deflected element. The non-wetting coating may be a self assembled monolayer, a molecular aggregation, or a non-wetting layer bonded to a seed layer. The module volume and the drainage volume may be hermetically open.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

In the manufacture of a fluid ejector head, particularly a piezoelectric printhead that includes a die with an array of fluid ejector units, it is possible to form various undesirable fluid leaks. For example, in inkjet printheads, ink leaks can short out an electrical connection. Also, leaked ink on a pumping array can stiffen the pumping membrane and reduce jet velocity. While a printhead can be designed to tolerate individual defective fluid ejector units, ink leaks tend to wick or spread to cover many fluid ejector units, typically leading to unacceptable print degradation and print head replacement. Also, because there are many possible sources for ink leaks, such as leakage at a bonding area between an interposer and the fluid ejection module, leakage from outside the module, and the like, preventing all such leaks is economically and practically difficult. Further, attempts to seal such print heads run into difficulties. For example, suitable adhesive seals are difficult to manufacture at atmospheric pressure, since as the print head assembly is heated to cure the adhesive, the air within the sealed volume expands and tends to blow out the seal. If the adhesive bond is made under vacuum, then the print head has a vacuum in it. Since such seals are typically not perfect, vacuum can be lost over time. This leads to a change in the pressure at the piezoelectric membrane and thus a change in the performance of the membrane, which can lead to unacceptable variations in jet output. Accordingly, there is a need to mitigate the effect of fluid leaks in fluid ejectors such as piezoelectric print heads.

Aspects of the construction and operation of fluid ejection modules can be found, for example, in U.S. Patent Pub. No. 2005/0099467, entitled "Print Head with Thin Membrane" and published May 12, 2005, the entire contents of which is hereby incorporated by reference. U.S. Patent Pub. No. 2005/0099467 describes examples of printhead modules and fabrication techniques.

Figure 1A:
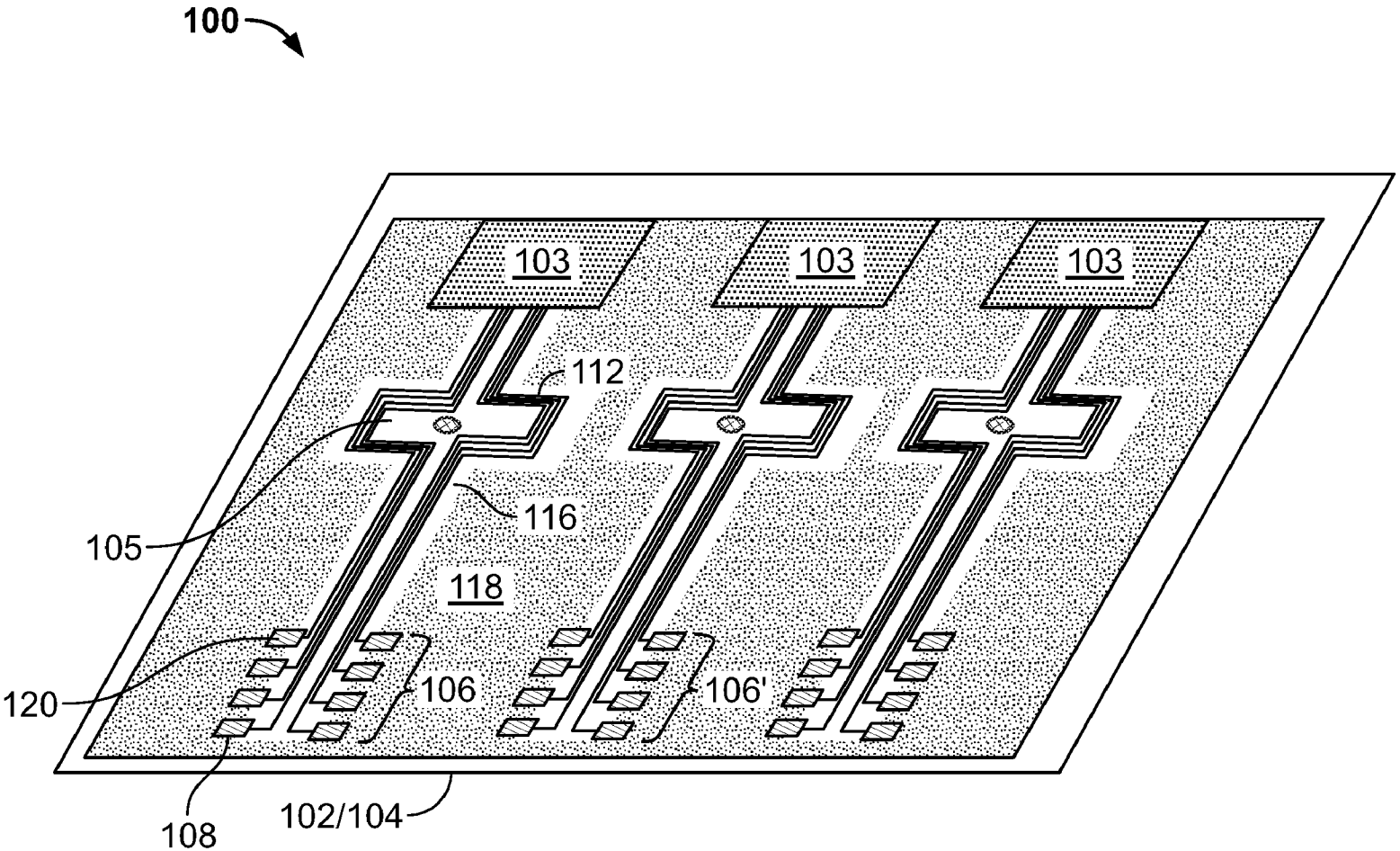
FIG. 1A is a perspective view of a die 104 of a fluid ejector head 100.

FIG. 1A is a perspective view of a die 104 of a fluid ejector head 100. Pumping arrays 106 at a surface 102 of the die 104 include actuators 120. Drive voltage signals are provided to the actuators 120 by conductive traces 112, e.g., an individual conductive trace for each actuator, and a common ground electrode 118. The conductive traces 112 and ground electrode 118 are coupled to one or more controllers, e.g., a separate microcontroller located in the printer or a general purpose computer. Optionally, the conductive traces 112 and ground electrode 118 can be routed to separately fabricated ASICs 103 mounted on the die 104, which themselves receive signals from the microcontroller or computer.

Figure 1B:
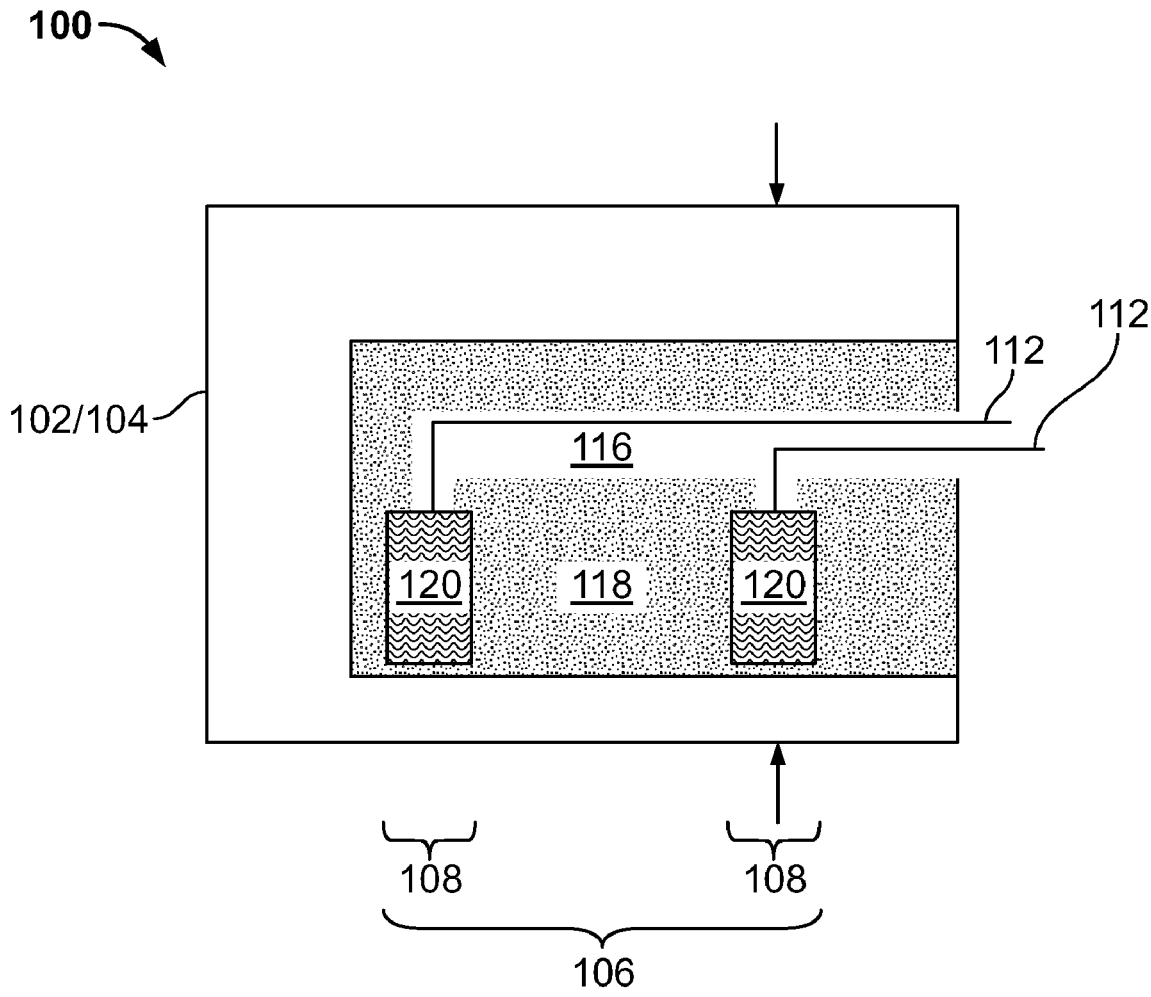
FIG. 1B is a top view of a die 104 of a fluid ejector head 100.
Figure 1C:
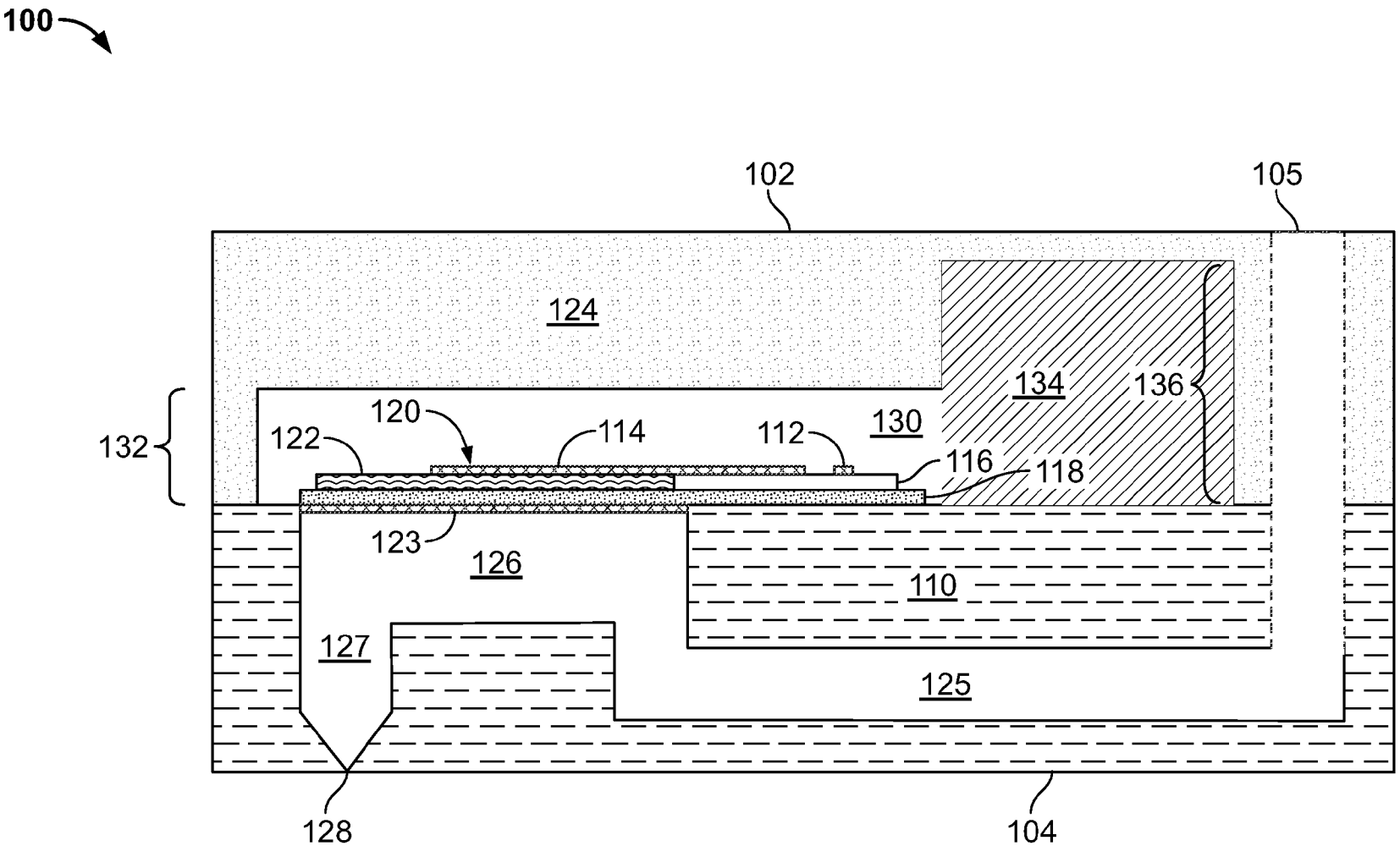
FIG. 1C depicts fluid ejector head 100, further including a manifold 124, as a side view in cross section through substrate 110 and pumping actuator 120.

FIG. 1B is a close-up top view of a portion of fluid ejector head 100. FIG. 1C is a cross section which depicts the fluid ejector head 100, including the die 104 and a manifold 124 mounted on the die 104. The location of the cross section of FIG. 1C corresponds to the arrows in FIG. 1B.

The pumping array 106 include multiple fluid ejector units 108. In various implementations, the actuators of the fluid ejector units can be piezoelectric deflectors, thermal bubble jet generators, or electrostatically deflected elements. Typically, the actuators are piezoelectric deflectors, and the fluid ejector head 100 is a piezoelectric fluid ejector head.

In the illustrated implementation, the die 104 includes a substrate 110 through which a plurality of passages 125 are formed, and a plurality of actuators 120, e.g., piezoelectric actuator structures, cause fluid to flow through associated passages. The substrate 110 can be a monolithic semiconductor body such as a silicon substrate. The passages 125 through the silicon substrate define flow paths for the fluid (e.g., ink) to be ejected (only one flow path and one actuator are shown in the cross-sectional view of FIG. 1). Each flow path is coupled through manifold 124 to a common inlet 105 in the surface 102 of the die 104, or separate inlets can be configured for one or more flow paths. Each flow path can include a pumping chamber 126, a descender 127, and a nozzle 128.

The actuator structure 120 itself could provide a wall of the pumping chamber 126, or a membrane layer 123 can be joined, e.g., bonded, to the module substrate 110 and form a membrane (i.e., a flexible portion of the membrane layer) over the pumping chamber 126. Each piezoelectric actuator structure 120 is positioned over the pumping chamber 126 and can be bonded to the exposed side of the membrane 123. Each piezoelectric actuator structure 120 includes a first electrode layer, e.g., the ground electrode 118, which can be a common ground electrode spanning multiple actuators, a second electrode layer, e.g., a drive electrode layer 114, connected to a conductive trace 112, and a piezoelectric layer 122 disposed between the first and the second electrode layers. The ground electrode layer 118 can be disposed between the piezoelectric layer 122 and the substrate 110. In areas outside the actuator structures 120, the ground electrode 118 is separated from drive electrodes 112 by an insulating layer 116. Although illustrated in FIG. 1B as exposed in regions outside the traces, ground electrode 118 can be covered by an insulating layer except where electrical connection is desired, e.g., at the edge of the die for connection to a flex circuit or for contact pads for the ASIC 103.

The piezoelectric layer 126 changes geometry in response to an applied voltage across the piezoelectric layer between the first electrode layer and the second electrode layer. The expansion or contraction of the piezoelectric layer 126 flexes the membrane 123 which in turn pressurizes fluid in the pumping chamber 126 to controllably force ink through the descender 127 and eject drops out of the nozzle 128. Thus, each flow path with its associated actuator provides an individually controllable fluid ejector unit.

The conductive traces 112 on the surface 102 of the die 104 can provide electrical connection to the drive electrodes 114 of the actuators 120. In addition, the traces 112 can be separated from the underlying ground electrode 118 by a common insulating layer 116.

The manifold 124 is depicted in contact with the first surface 102 of the die 104. Recesses can be formed on the bottom surface of the manifold 124 between the regions that contact the die to form a manifold space between the manifold 124 and the die 104. The manifold space includes two volumes, a module volume 130 (unshaded) in fluidic communication with a drainage volume 134 (diagonally shaded). The module volume 130 is defined in part between the manifold 124 and at least a first portion of the die 104. Typically, a module volume 130 of the manifold space is located over components of the die 104 onto which leaked fluid would be least desirable, e.g., over the actuator 120, including the drive electrode 114, over the portion of the membrane 123 or actuator layer 122 that flexes, or over the conductive traces 112. By contrast, the drainage volume 134 is typically located apart from such fluid sensitive components, for example, as shown in FIG. 1C, substantially bounded by the manifold 124 and a separate second portion of the die 104. Portions of the module volume 130 and drainage volume 134 can extend over exposed portions of the ground electrode, or the ground electrode 134 can be covered by the insulating layer over the entire module volume 130 and drainage volume 134.

Also, module volume 130, in comparison to drainage volume 134, is depicted with a cross section that correlates to a higher surface to volume ratio than a surface to volume ratio of drainage volume 134. A higher surface to volume ratio can be provided for module volume 130 as compared to drainage volume 134, for example, where at least one dimension of module volume 130 is less than any dimension of drainage volume 134. In particular, FIG. 1C depicts module volume 130 which has a lesser 'height' 132 as compared to drainage volume 134 at greater 'height' 136. Such 'height' can be measured between the manifold 124 and first surface 102 along a line that is normal to first surface 102. In various implementations, the inner surface of the manifold recess can be separated from the die to give a 'height' of between about 1 and about 20 micrometers. In various implementations, this lesser dimension of module volume 130 could be along a direction other than normal to first surface 102, for example, along a line parallel to first surface 102.

In various implementations, module volume 130 and drainage volume 134 are hermetically open to ambient air pressure, that is, not hermetically sealed. Stated another way, the manifold space can vent to atmosphere, permitting pressure equalization. The hermetically open nature of the manifold space can be implemented by the nature of the contact between manifold cover 124 and the first surface 102 of die 104, which can be, e.g., a porous bond, or a bond with one or more gaps, and the like. Additionally, one or more vents (not shown) can be incorporated into the manifold cover and/or the die to couple the manifold space to the outside atmosphere. The method can include equalizing a pressure in the volumes with ambient pressure.

Figure 1D:
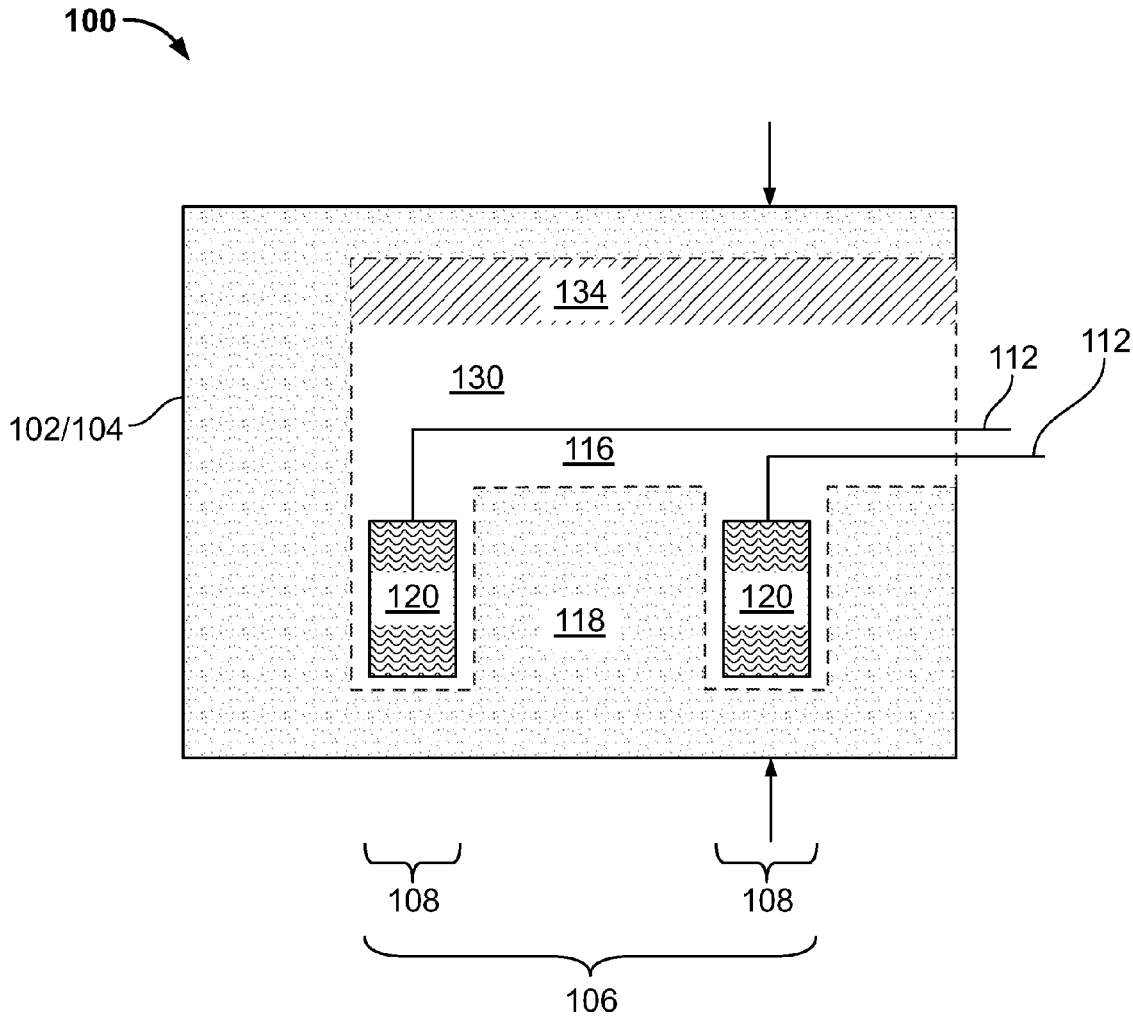
FIG. 1D is a top view depicting fluid ejector head 100 as in FIG. 1B, but further including manifold 124.

In various implementations, the manifold space can be tailored, e.g., laterally dimensioned, i.e., parallel to the surface of the substrate, with respect to the components at the die. FIG. 1D is a top view depicting fluid ejector 100 as in FIG. 1B, but further including manifold 124. Some features of FIG. 1B are omitted for clarity. Manifold 124 can contact die 104 in the area outside the dashed line boundary. Inside the dashed line boundary, drainage volume 134 (diagonal shading) can be located apart from actuators 120 and traces 112. Also inside the dashed line boundary, module volume 130 can typically be located over at least a portion of the die 104 that includes the actuators 120 and traces 112. FIG. 1D, in combination with FIG. 1C, also further demonstrates that module volume 130 has a higher surface to volume ratio than drainage volume 134. Dimension 132 of module volume 130, depicted in FIG. 1C, is less than dimension 136 of drainage volume 134, and is also less than the dimensions of drainage volume 134 depicted in FIG. 1D.

Figure 1E:
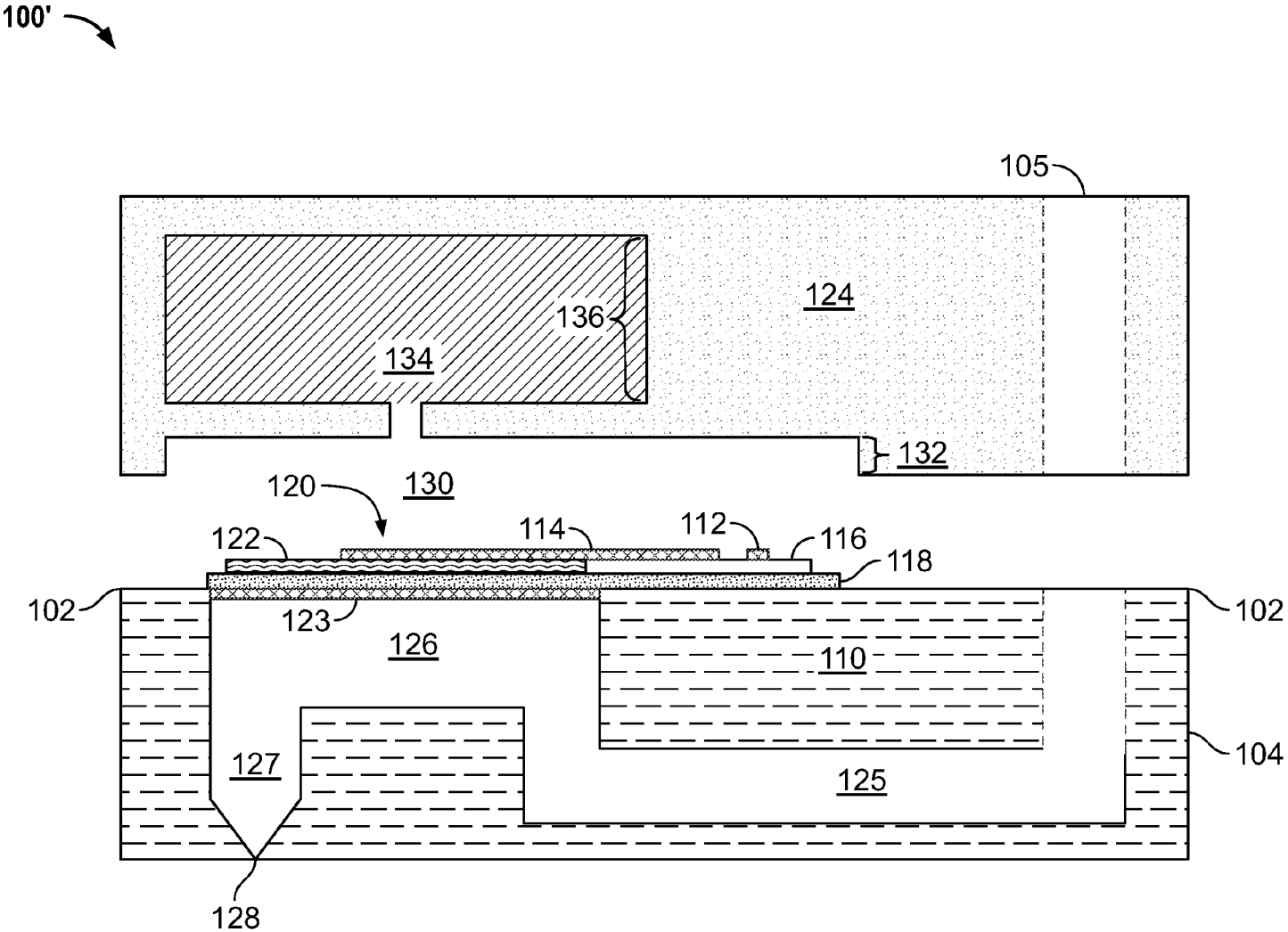
FIG. 1E depicts a side view of fluid ejector head 100' in cross section, similar to fluid ejector head 100 in FIG. 1C. For clarity, fluid ejector head 100' is depicted in partly exploded form, with manifold 124 separated from die 104.

Various implementations provide other geometries which lead to a higher surface to volume ratio for module volume 130 as compared to drainage volume 134. For example, FIG. 1E depicts a side view of fluid ejector head 100' in cross section, similar to fluid ejector head 100 in FIG. 1C. For clarity, fluid ejector head 100' is depicted in partly exploded form, with manifold 124 separated from die 104. As in FIG. 1C, module volume 130 has a greater surface to volume ratio than drainage volume 134, as demonstrated in part by lesser dimension 132 of module volume 130 as compared to dimension 136 of drainage volume 134. As in FIG. 1C, module volume 130 and drainage volume 134 are in fluidic communication, but in contrast to FIG. 1C, drainage volume 134 is located largely within manifold 124.

Figure 1F:
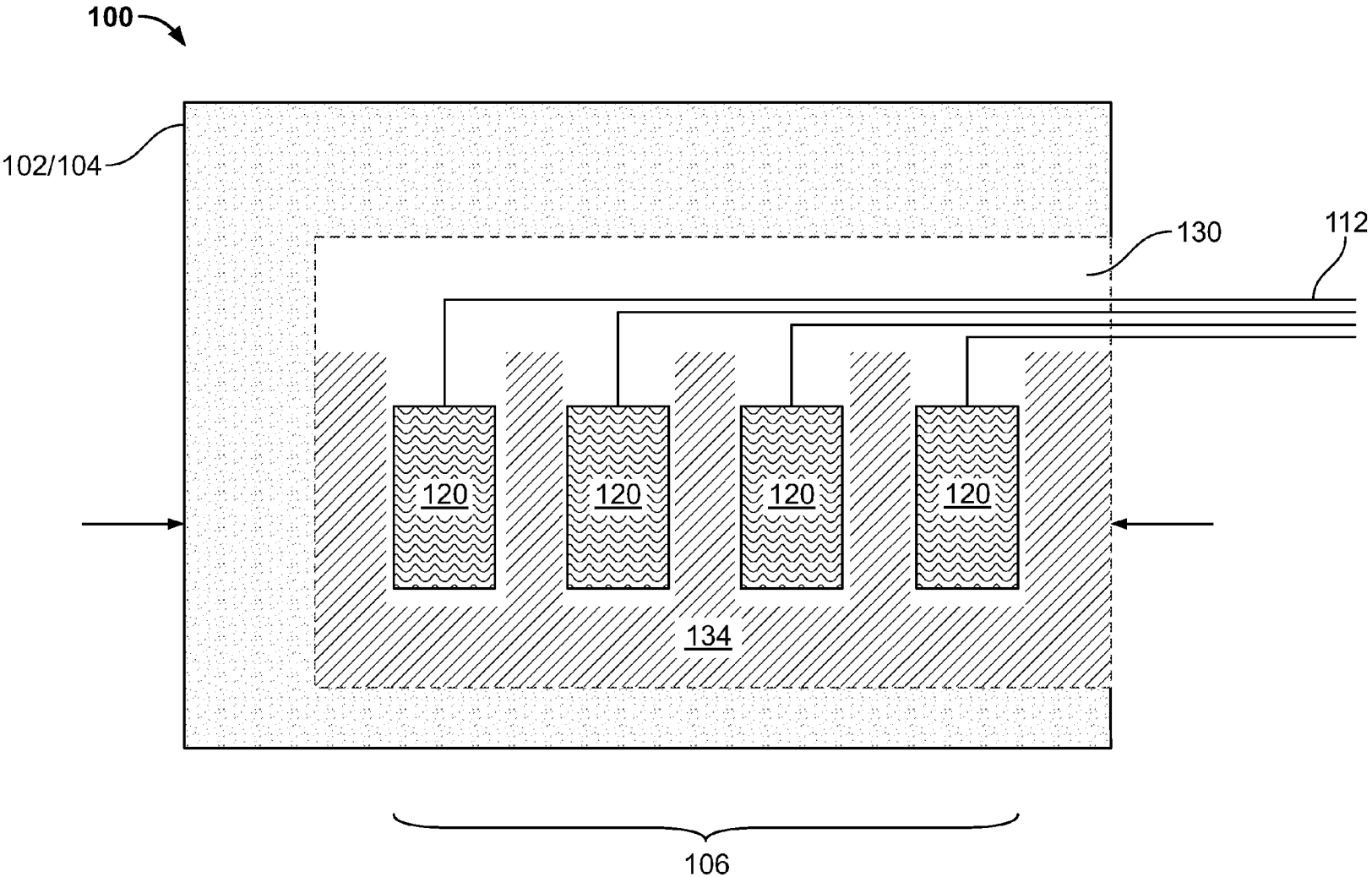
FIG. 1F depicts a top view is a top view depicting fluid ejector head 100 with another configuration of manifold 124 which leads to a higher surface to volume ratio for module volume 130 as compared to drainage volume 134.
Figure 1G:
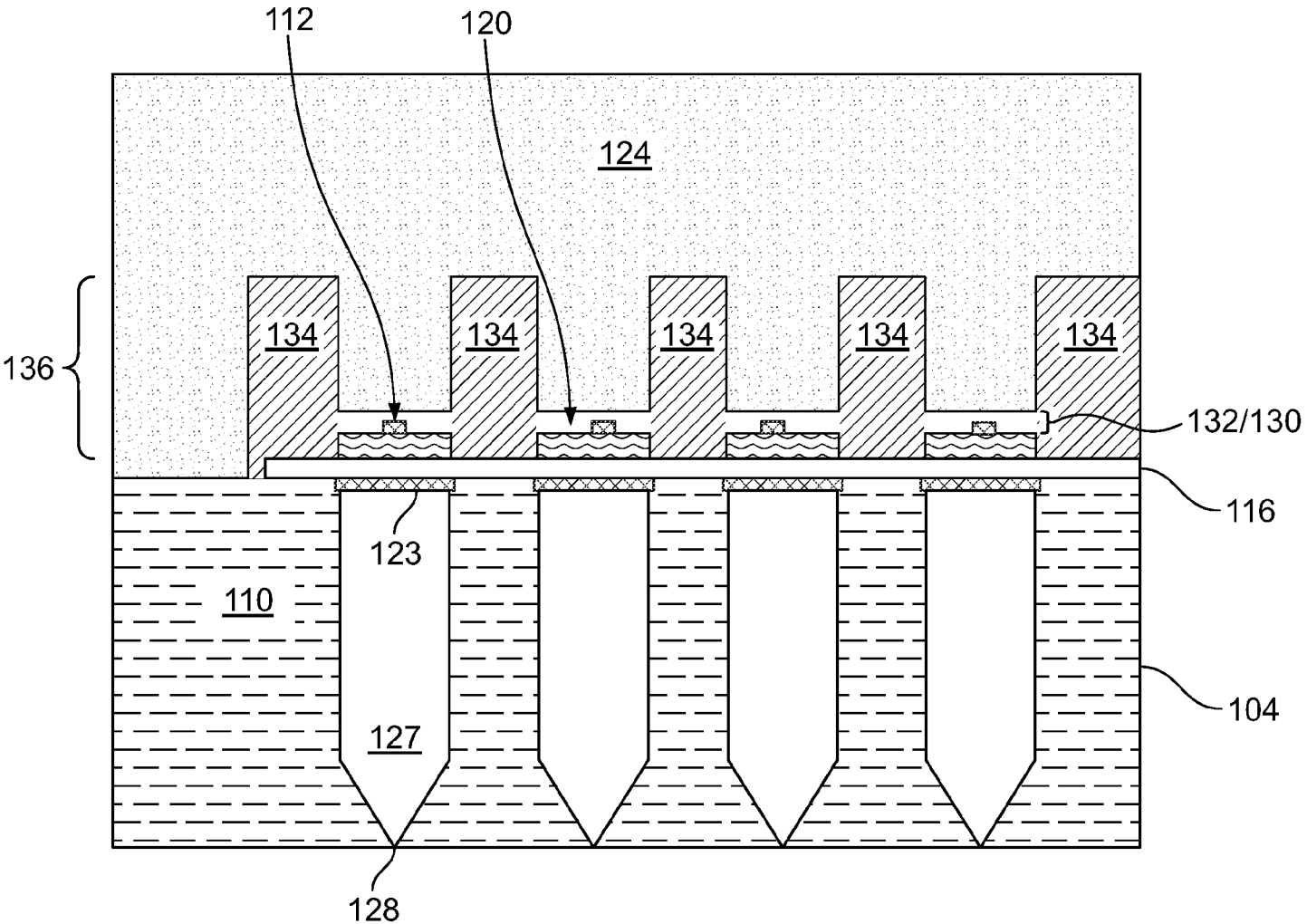
FIG. 1G depicts a cross section corresponding to the arrows in FIG. 1F.

FIG. 1F depicts a top view of another geometry which can lead to a higher surface to volume ratio for module volume 130 as compared to drainage volume 134. As in FIG. 1D, manifold 124 can contact die 104 outside the dashed line boundary. Inside the dashed line boundary, drainage volume 134 (diagonal shading) can be located apart from actuators 120 and traces 112. In particular, the drainage volume 134 can extend in regions between adjacent actuators 120 and on the sides of the actuators further from the traces 112. Also inside the dashed line boundary, module volume 130 can be located over at least a portion of the die 104 that includes the actuators 120 and traces 112. FIG. 1G depicts a cross section corresponding to the arrows in FIG. 1F which shows features in manifold 124 which provide a lower 'height' 132 over the actuators and a higher 'height' 136 in between the actuators, thus leading to a higher surface to volume ratio for module volume 130 as compared to drainage volume 134.

FIGS. 1H-L depict top views of additional configurations which can lead to a higher surface to volume ratio for module volume 130 as compared to drainage volume 134.

Figure 1H:
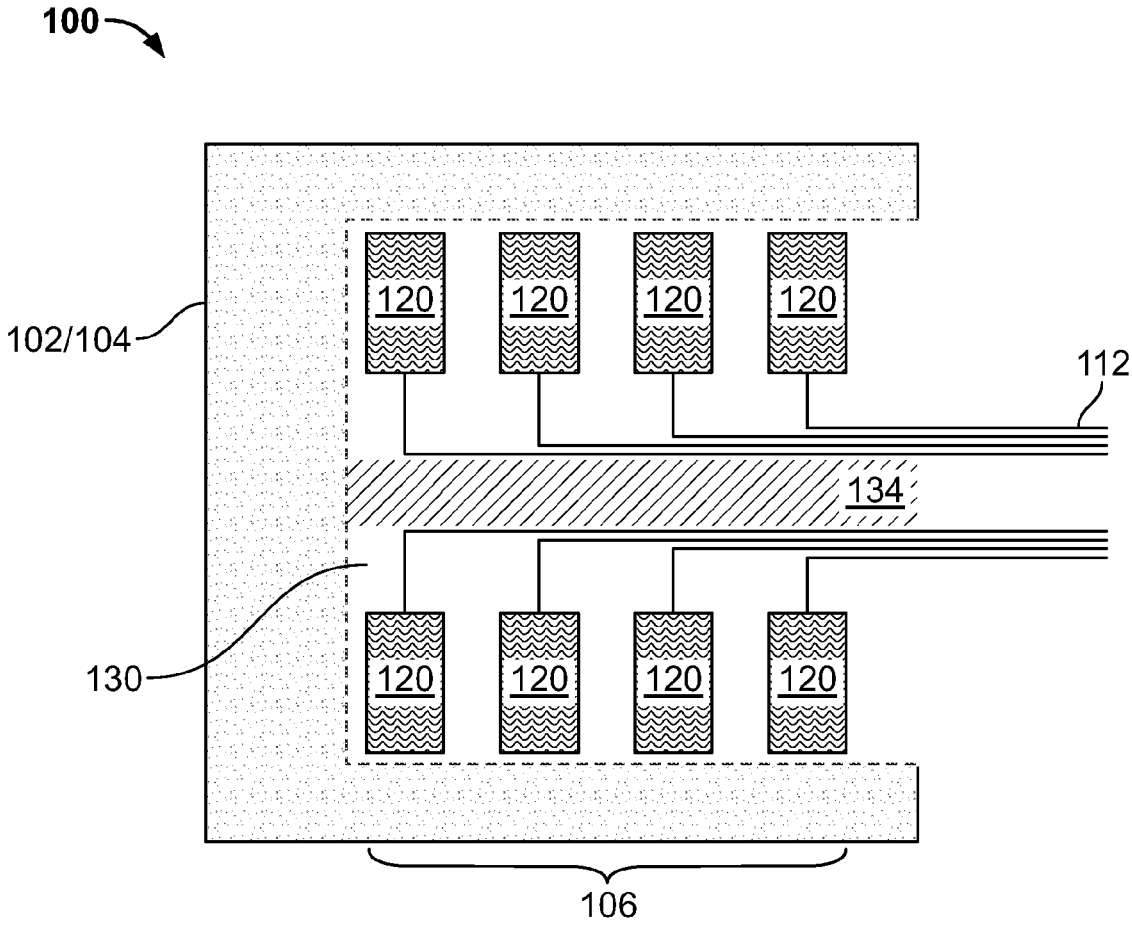
FIGS. 1H-L depicts top views of additional configurations of manifold 124 at fluid ejector head 100 which lead to a higher surface to volume ratio for module volume 130 as compared to drainage volume 134.

In FIG. 1H, manifold 124 is configured to provide drainage volume 134 at a location over insulating layer 116 between traces 112. Thus, this drainage volume 135 can located in the area between the two parallel rows of actuators. The module volume 130 is located over the actuators 120, over the regions between adjacent actuators in a row of actuators, and over traces 112. Manifold 124 contacts surface 102 and components at surface 102, such as electrodes 118 and/or 112, outside the dashed box.

Figure 1I:
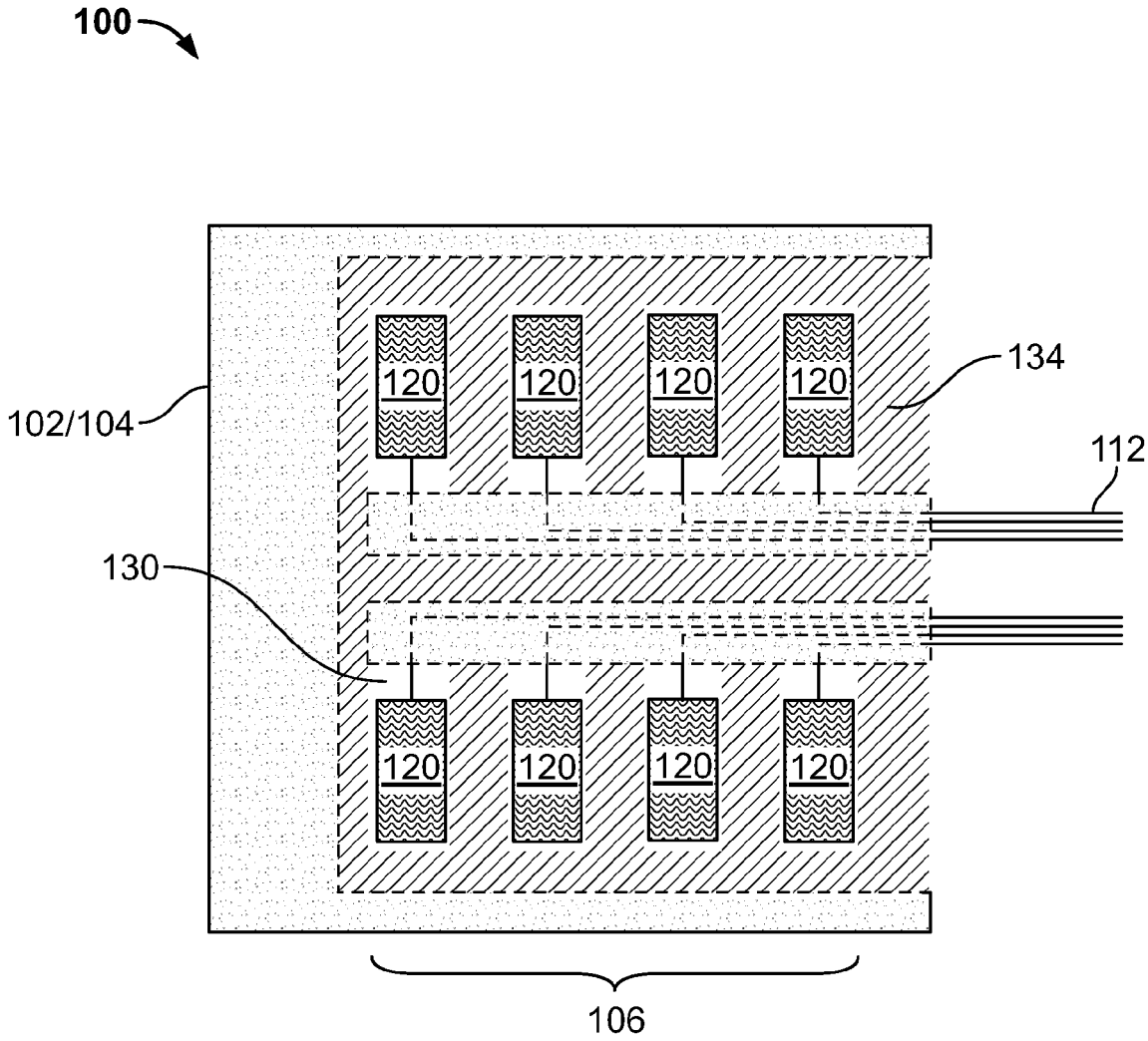

In FIG. 1I, manifold 124 contacts the surface 102 of the die 104 over some stationary components of the fluid ejector module, such as over some portions of the conductive traces 112 (these portions of the traces 112 can be covered by an additional protective layer to prevent direct contact with the manifold 124). The manifold 124 is configured to provide drainage volume 134 at a location between traces 112 and between adjacent actuators 120, while the module volume 130 is located over the actuators 120 and portions of traces 112 that are not contacted by the manifold.

Figure 1J:
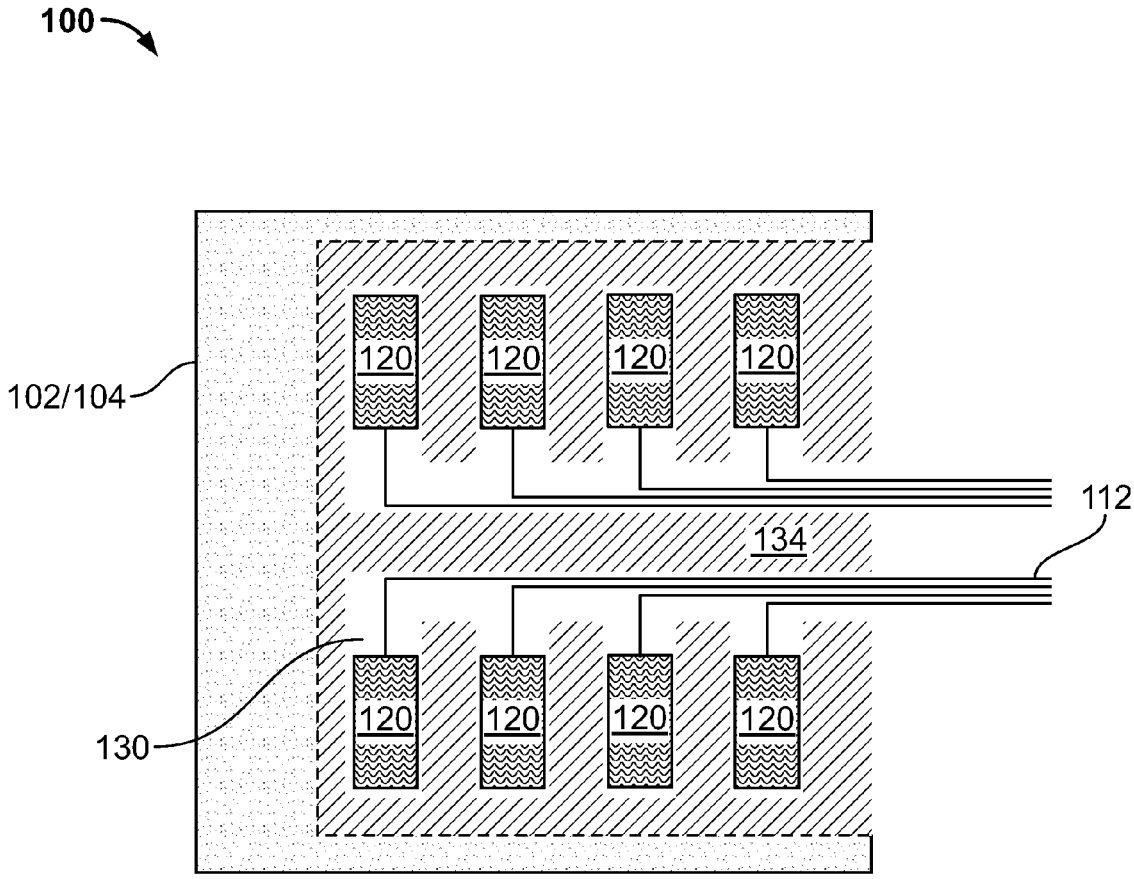

In FIG. 1J, manifold 124 is configured to provide drainage volume 134 at a location between traces 112, and to extend drainage volume 134 between actuators 120, and on the sides of the actuators further from the traces 112, while the module volume 130 is located over the actuators 120 and traces 112.

Figure 1K:
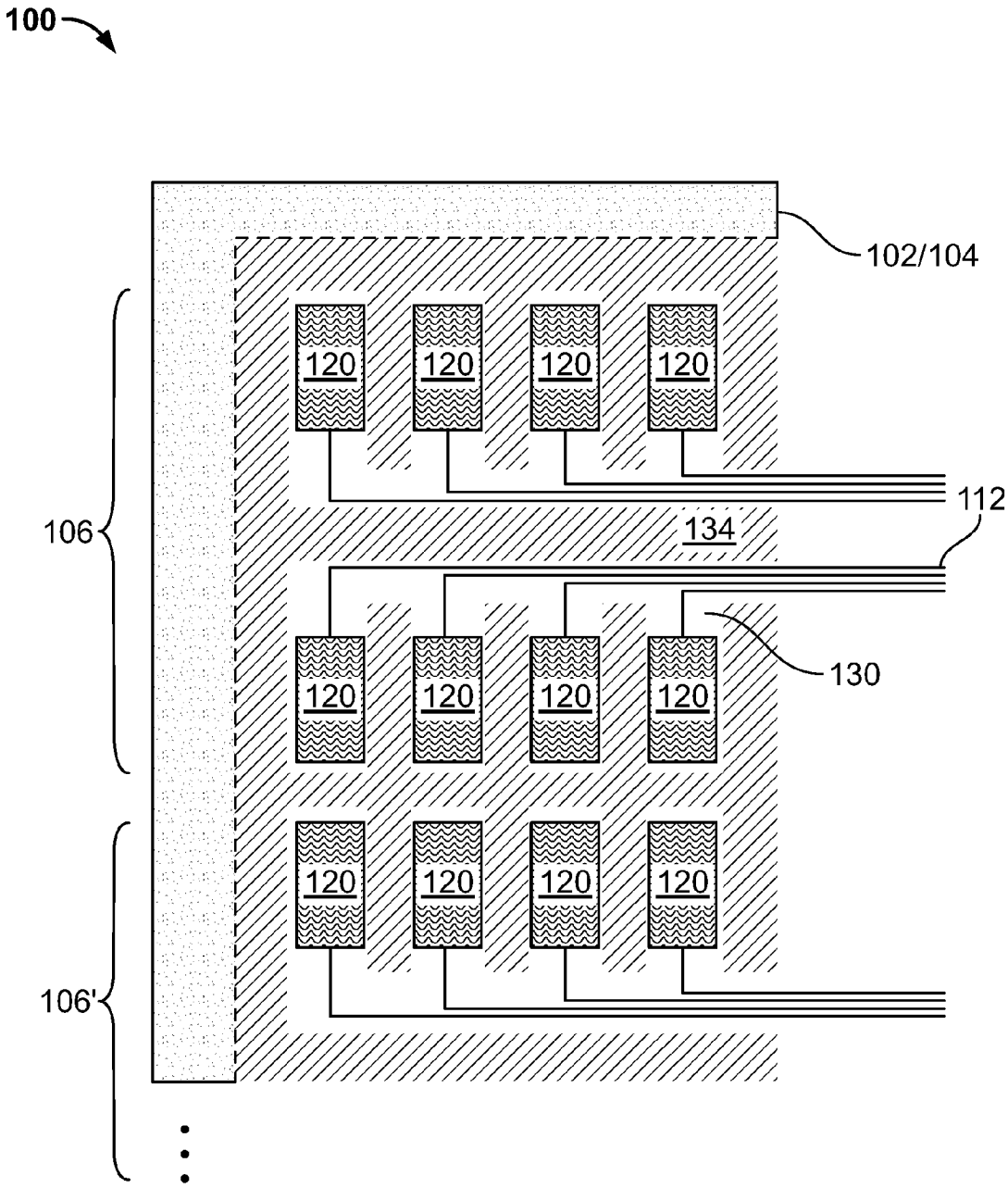

FIG. 1K shows that manifold 124 can be configured so that drainage volume 134 extends over multiple pumping arrays, such as pumping arrays 106 and 106' (see also FIG. 1A). One of ordinary skill can determine other geometric configurations of manifold 124 which will give module volume 130 a higher surface to volume ratio than that for drainage volume 134.

Figure 1L:
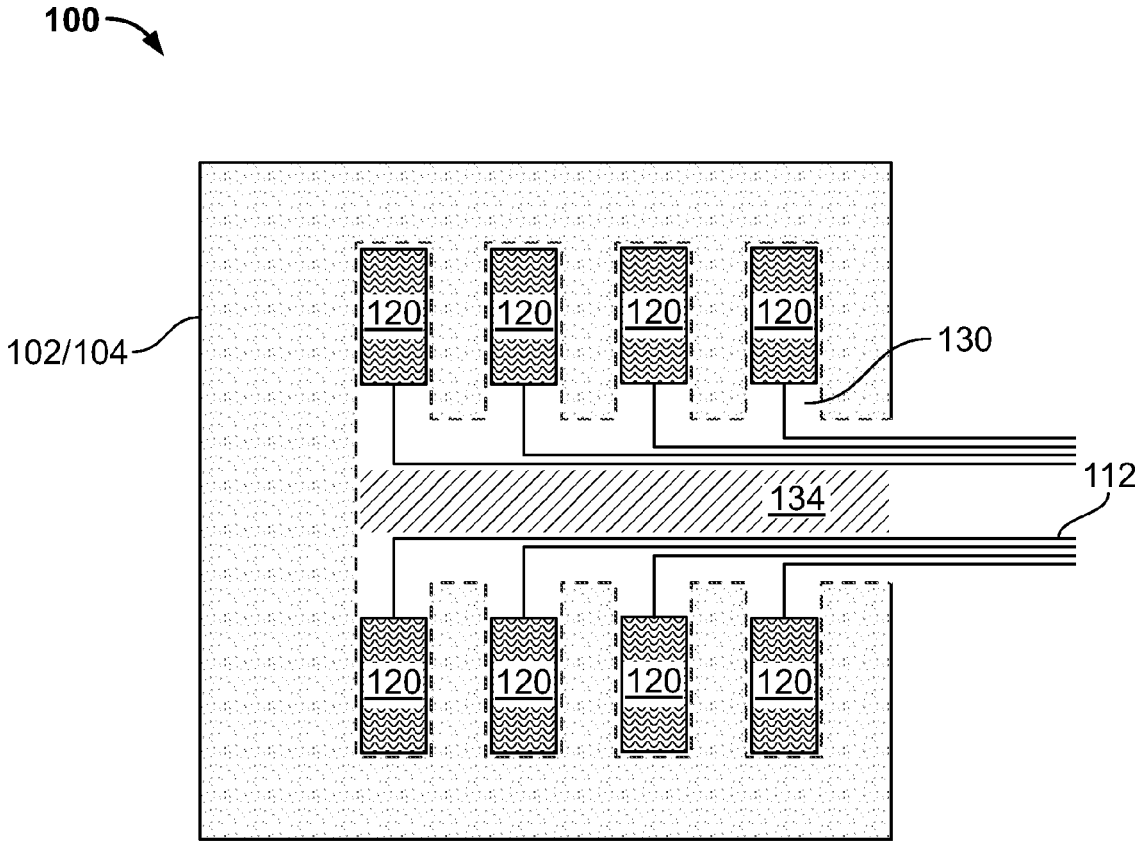

FIG. 1L is similar to FIG. 1H in that manifold 124 is configured to provide drainage volume 134 at a location between traces 112, while the module volume 130 is located over the actuators 120 and traces 112. In FIG. 1L, the area of contact between manifold 124 and surface 102 is greater than in FIG. 1H since the contact further extends between individual actuators 120.

In general, implementations, in which the module volume 130 is open on only one side to a drainage volume, such as FIGS. 1D and 1L, in which the module volumes 130 are closed on three sides by contact of the manifold to the die, can be modified so that the module volume 130 is open two sides, e.g., two opposing sides, to drainage volumes, in order to permit free flow of air through the manifold volume and thus easier flow of liquid out of the manifold volume.

Figure 2A:
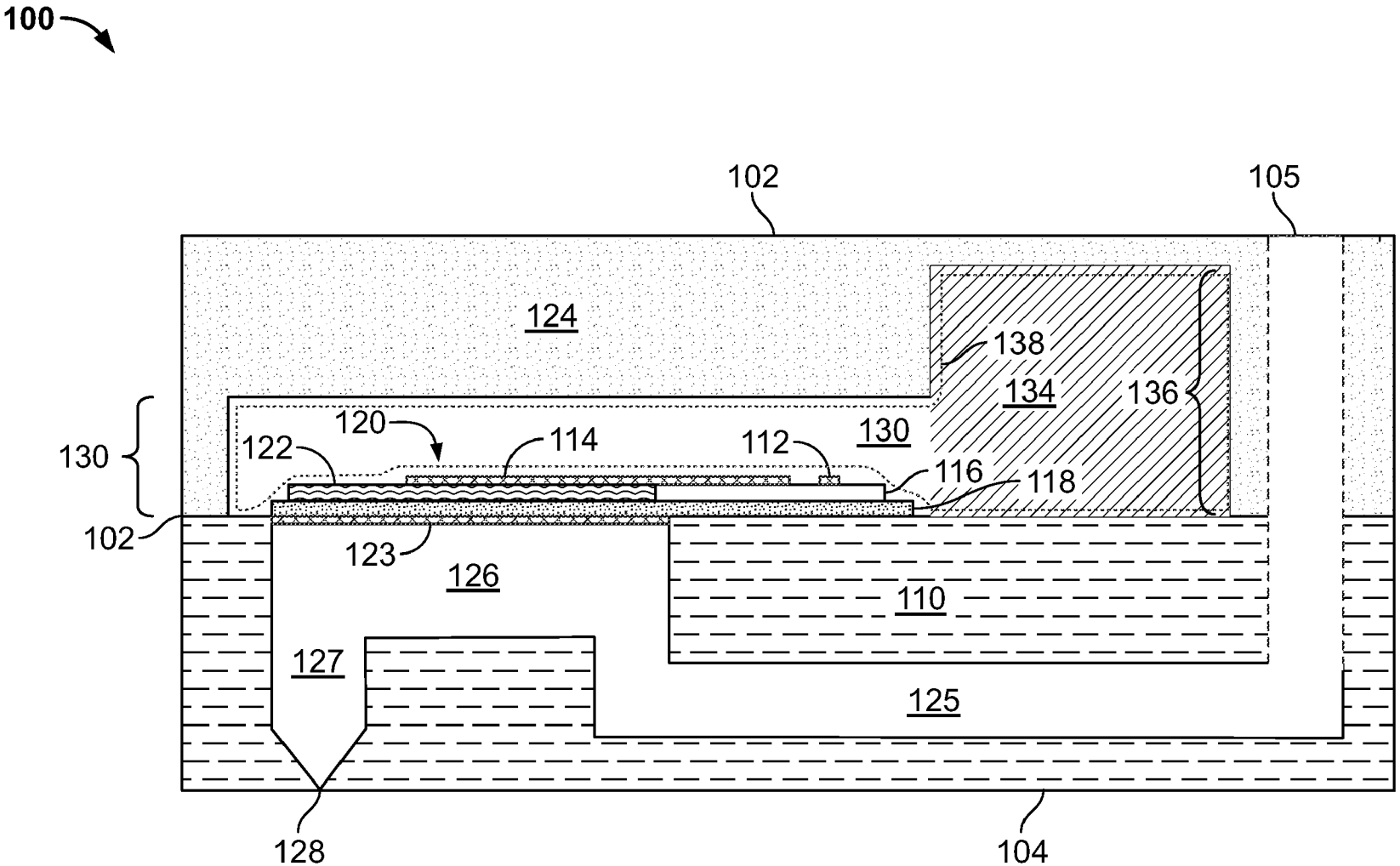
FIG. 2A depicts a side view of fluid ejector head 100 in cross section as in FIG. 1C, with the addition of non-wetting coating 138 (dotted line).

In various implementations, a non-wetting coating 138 is provided at surfaces within the manifold space. FIG. 2A depicts a side view of fluid ejector head 100 in cross section as in FIG. 1C, with the addition of non-wetting coating 138 (dotted line). In various embodiments, non-wetting coating 138 can coat each surface within the manifold space (module volume 130 and drainage volume 134) defined between manifold 124, first surface 102 of die 104, and components at first surface 102 such as pumping actuator 120 (including electrode 114), traces 112, and the like.

Figure 2B:
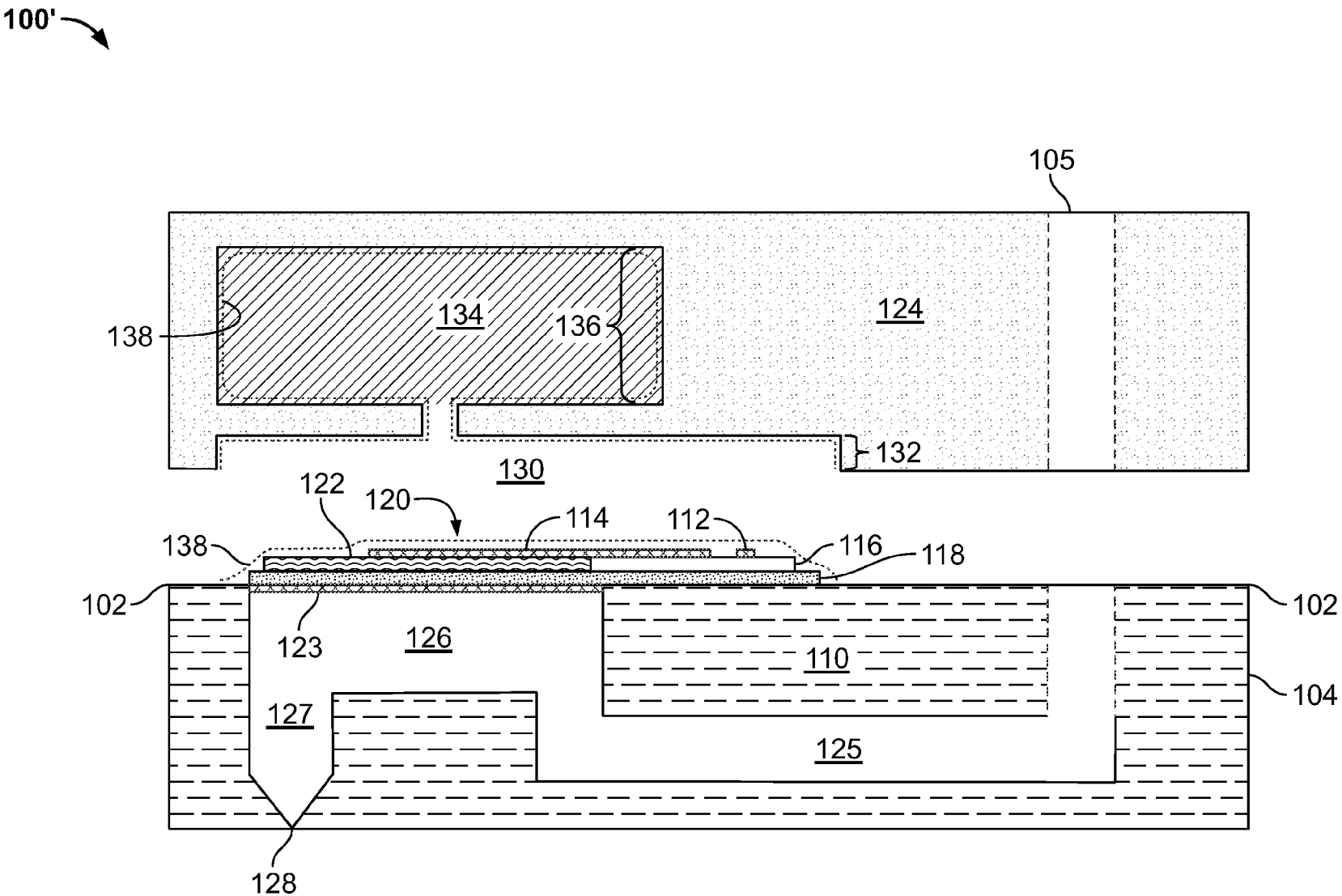
FIG. 2B depicts fluid ejector head 100' as in FIG. 1D, but with the addition of non-wetting coating 138, which can coat each surface within the manifold space similar to FIG. 2A.

FIG. 2B depicts fluid ejector head 100' as in FIG. 1D, but with the addition of non-wetting coating 138, which can coat each surface within the manifold space similar to FIG. 2A.

In various implementations, non-wetting coating 138 can contact selected surfaces within the manifold space. Such selective coating can be prepared by selective deposition and/or selective removal of the non-wetting coating during manufacture, for example, by coating pieces separately, or by masking (e.g., with a photoresist) areas which are not to be coated or to reveal portions of a coating to be removed, and the like.

Figure 2C:
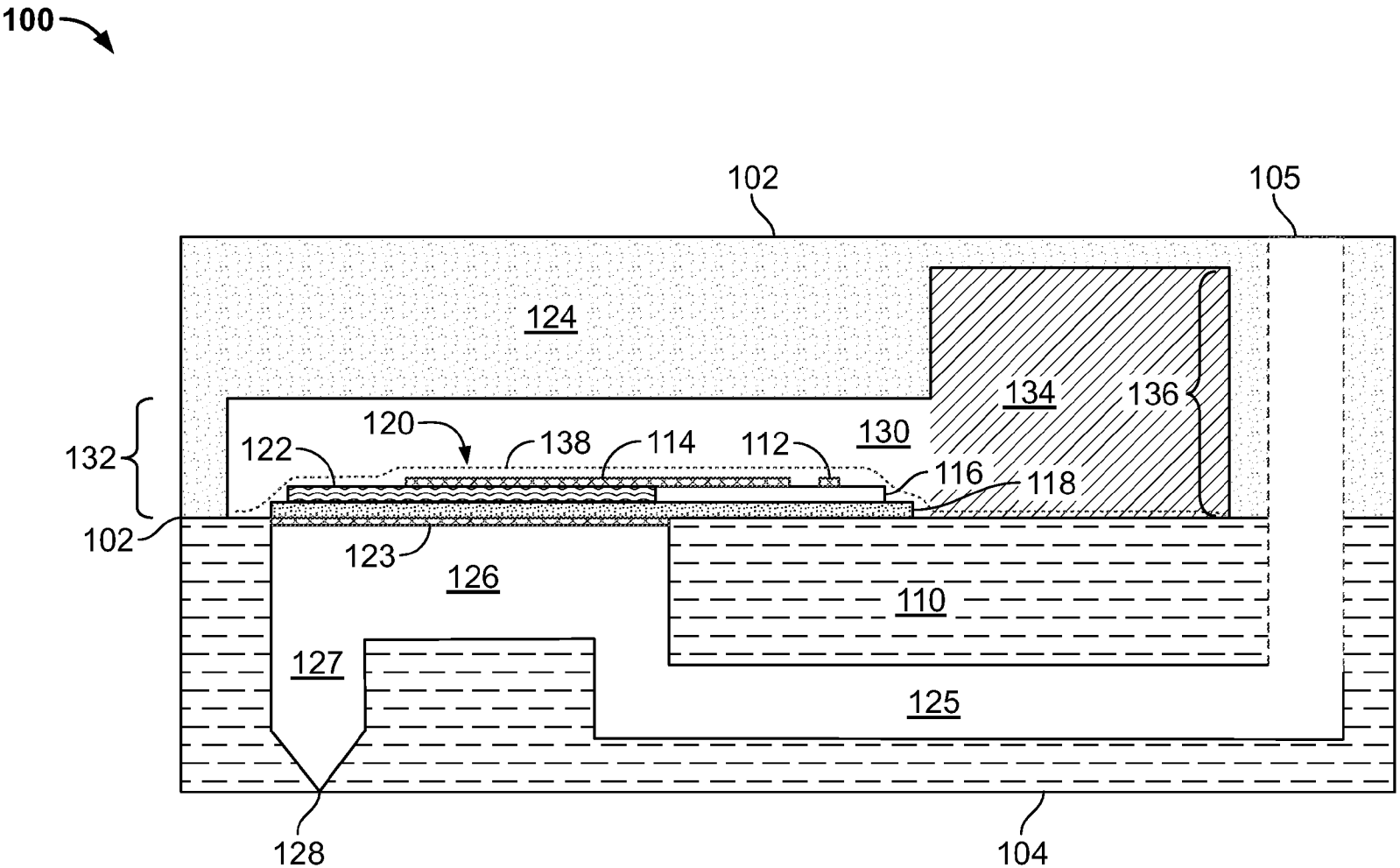
FIGS. 2C and 2D depict fluid ejector head 100 and 100', respectively, in which non-wetting coating 138 is located at first surface 102 of die 104 and components at first surface 102.
Figure 2D:
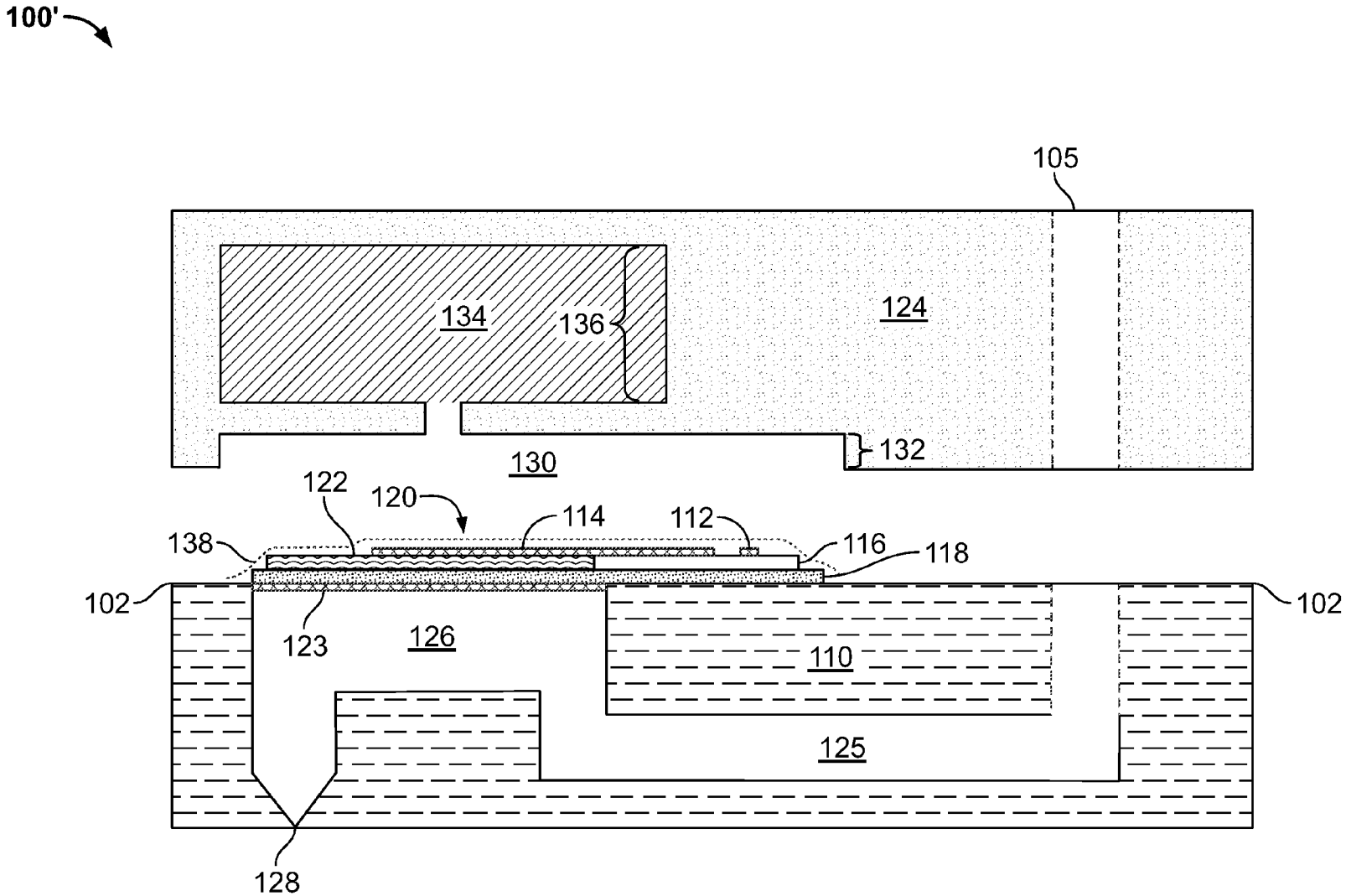

FIGS. 2C and 2D depict fluid ejector head 100 and 100', respectively, in which non-wetting coating 138 is located at first surface 102 of die 104 and components at first surface 102 such as pumping actuator 120 (including electrodes 114), traces 112, and the like. Such a configuration of nonwetting coating 138 can be applied by coating first surface 102 of die 104 and components at first surface 102, but leaving manifold 124 uncoated.

Figure 2E:
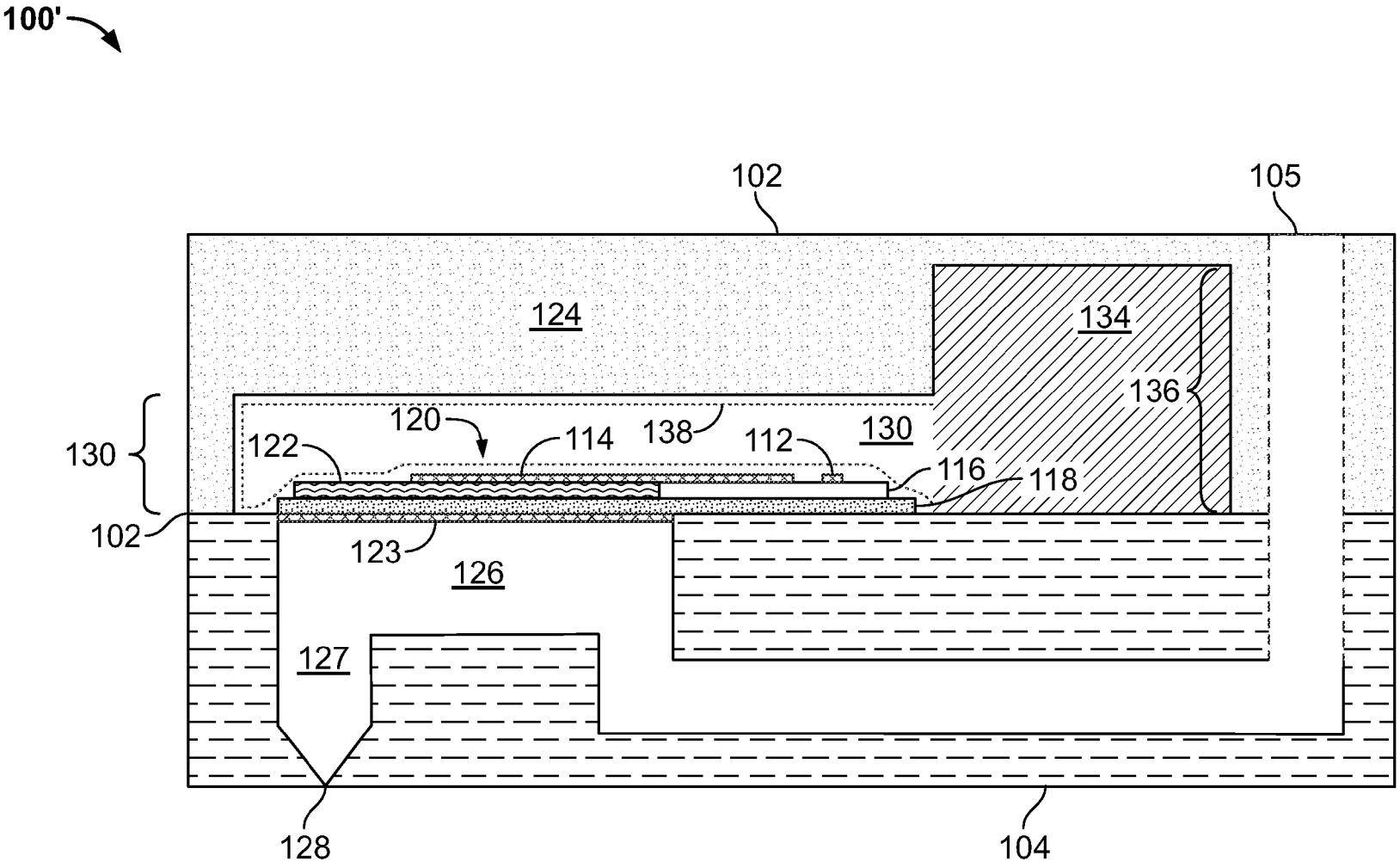
FIGS. 2E and 2F depict fluid ejector head 100 and 100', respectively, in which non-wetting coating 138 is located at surfaces which border module volume 130, but surfaces which border drainage volume 134 are not coated with non-wetting coating 138.
Figure 2F:
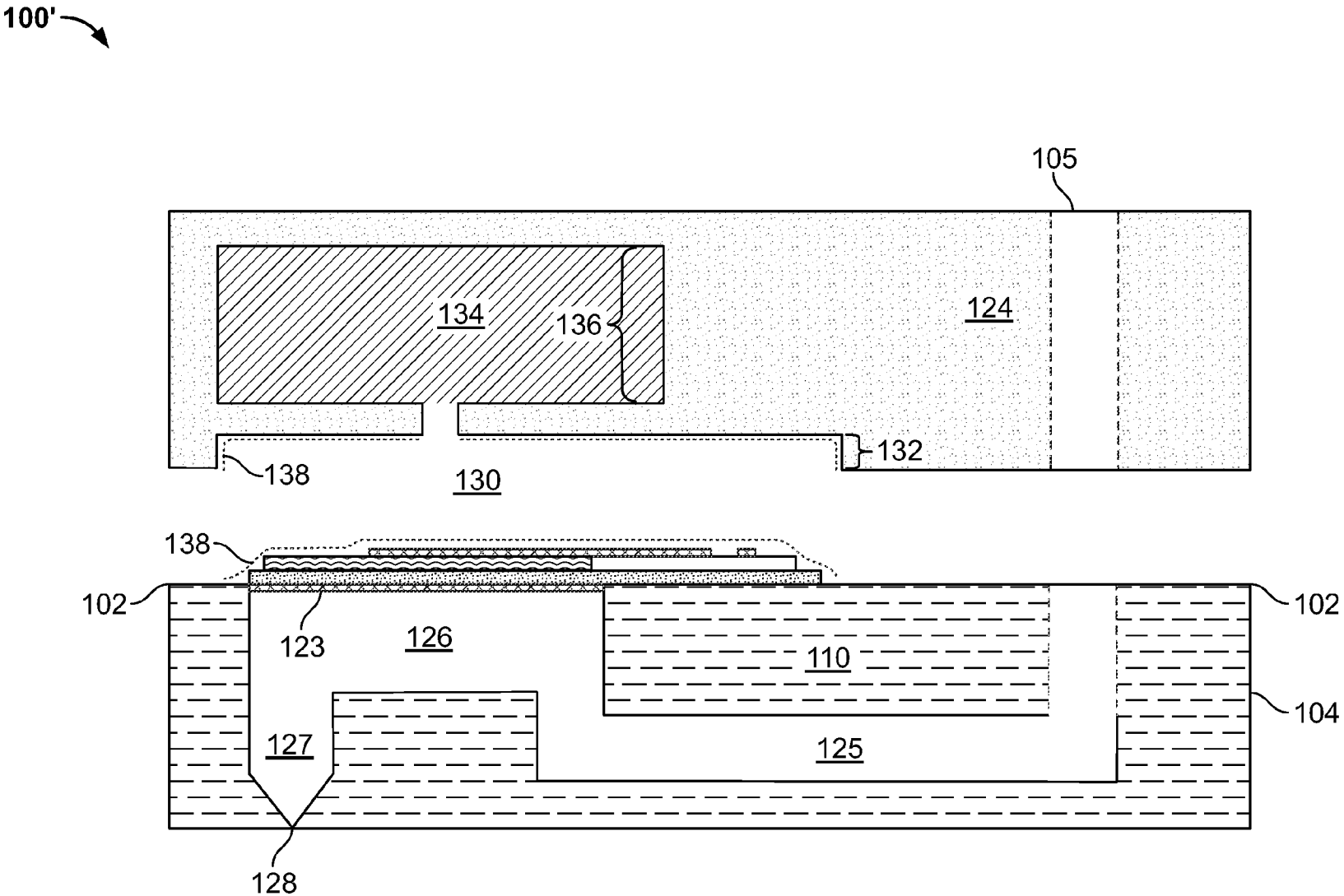

FIGS. 2E and 2F depict fluid ejector head 100 and 100', respectively, in which non-wetting coating 138 is located at surfaces which border module volume 130, such as first surface 102 of die 104 and components at first surface 102 such as pumping actuator 120 (including electrodes 114), traces 112, and the like, and also manifold 124. However, portions of manifold 124 and first surface 102 of die 104 which border drainage volume 134 are not coated with nonwetting coating 138. Such a configuration of nonwetting coating 138 can be achieved by selective application and/or removal of nonwetting coating 138, for example, using a mask such as a photoresist.

Thus, FIGS. 2C-2F also demonstrate that module volume 130 can have a greater percentage of interior surface area covered by non-wetting coating 138 as compared to drainage area 134.

In various implementations, a non-wetting coating 138 can be a self-assembled monolayer, i.e., a single molecular layer. Such a non-wetting coating monolayer 138 can have a thickness of about 10 to 20 Angstroms, e.g., about 15 Angstroms. Alternatively, the non-wetting coating 138 can be a molecular aggregation. In a molecular aggregation, the molecules are separate but held in the aggregation by intermolecular forces, e.g., by hydrogen bonds and/or Van der Waals forces, rather than ionic or covalent chemical bonds. Such a non-wetting coating aggregation 138 can have a thickness of about 50 to 1000 Angstroms. The increased thickness of the non-wetting coating can make the non-wetting coating more durable and resistant to a wider range of fluids. The non-wetting coating can be a non-wetting layer bonded to a seed layer. For example, the non-wetting coating can be formed of a non-wetting layer bonded to a seed layer, the seed layer comprising silicon dioxide. For example, the non-wetting coating can include a siloxane chemically bonded to the seed layer. Typically, the non-wetting layer and seed layer can together have a thickness between 50 and 1000 Angstroms.

The molecules of the non-wetting coating can include one or more carbon chains terminated at one end with a $—CF_3$ group. The other end of the carbon chain can be terminated with a $SiCl_3$ group, or, if the molecule is bonded to a silicon oxide layer, terminated with a Si atom which is bonded to an oxygen atom of the silicon oxide layer (the remaining bonds of the Si atom can be filled with oxygen atoms that are connected in turn to the terminal Si atoms of adjacent non-wetting coating molecules, or with OH groups, or both. In general, the higher the density of the non-wetting coating, the lower the concentration of such OH groups). The carbon chains can be fully saturated or partially unsaturated. For some of the carbon atoms in the chain, the hydrogen atoms can be replaced by fluorine. The number of carbons in the chain can be between 3 and 10. For example, the carbon chain could be $(CH_2)_M(CF_2)_NCF_3$, where $M \geqq 2$ and $N \geqq 0$, and $M+N \geqq 2$, e.g., $(CH_2)_2(CF_2)_7CF_3$.

Thus, in various implementations, the non-wetting coating can include molecules formed from at least one precursor from the group consisting of tridecafluoro 1,1,2,2 tetrahydrooctyltrichlorosilane (FOTS) and 1H,1H,2H,2H perfluorodecyl-trichlorosilane (FDTS). In various implementations, a step of coating can include holding components to be coated, e.g., the fluid ejector modules, in a chamber at a first temperature, and flowing a precursor of the non-wetting coating into the chamber at a second temperature higher than the first temperature. A temperature difference between the first and second temperatures can be at least 70° C. The precursor can include at least one of tridecafluoro 1,1,2,2 tetrahydrooctyltrichlorosilane (FOTS) or 1H,1H,2H,2H perfluorodecyltrichlorosilane (FDTS).

In various implementations, the step of coating can include depositing a seed layer on a surface of the fluid ejector modules, the seed layer including water molecules trapped in an inorganic matrix, and depositing a non-wetting coating on the seed layer.

In various implementations, the step of coating can include depositing a seed layer on a surface of a component to be coated, e.g., the fluid ejector modules; applying an oxygen plasma to the seed layer; and depositing a non-wetting layer on the seed layer on the surface of the fluid ejector module. The seed layer can include silicon dioxide. Thus, non-wetting coating can include a siloxane chemically bonded to the seed layer.

Further details of the chemistry and application of the non-wetting coating are described in U.S. Prov. Pat. Appl. No. 61/109,754, filed Oct. 30, 2008, the entire contents of which are incorporated herein by reference.

The non-wetting coating 138 can be effective in repelling leaked fluid away from the pumping array 106, particularly away from fluid ejection units 108, and components thereof. The non-wetting coating can be more effective when combined with the surface area to volume ratio discussed above, and particularly when one dimension of the module volume is less than each dimension of the drainage volume.

Without wishing to be bound by theory, it is believed that the combination of the geometry with the non-wetting coating can focus the repellent activity of the non-wetting coating. A fluid at a non-wetting coating has a higher contact angle, due to surface tension, than at a surface without the coating that is more wettable. Such surface tension can lead to increasing the forcing pressure required to confine the fluid to a dimension below that which permits fluid droplets to freely assume the contact angle corresponding to the surface tension for a particular fluid and non-wetting coating combination. Consequently, a fluid can experience significant pressure when confined in volume with a non-wetting coating, wherein the volume has at least one dimension that is small compared to fluid droplets which freely assume the contact angle corresponding to the surface tension for a particular fluid and non-wetting coating combination.

For example, consider the pressure which may be needed to force a fluid into a channel coated with a non-wetting coating, where the channel has a rectangular cross section with one dimension much less than the other. This forcing pressure can be calculated as approximately equal to SurfaceTension/NarrowDimension in appropriate units. For example, for an ink with a surface tension of 30 dynes/centimeter at a particular non-wetting coating, and a correspondingly coated channel with a narrow dimension of 10 micrometers, this pressure forcing pressure is about 3000 Pascals. While certain operating pressures for a fluid ejector head may exceed this value, for example, a purge pressure, the ink can be driven back out of the channel by the channel pressure once the purge pressure is stopped. One need only make the channel long enough that it is not completely filled with ink during the purge.

A drain channel can extend from the drainage volume to allow fluid to be expelled during purging. This drain channel can be formed as a recess on the bottom surface of the manifold, or can extend vertically through the manifold. The drain channel can have at least one dimension that is slightly bigger than the smallest dimension of the module volume (so that the pressure in the module volume is greater than the pressure needed to force fluid out the hole) and can be treated with a non-wetting coating to inhibit fluid from entering the printhead from the outside. Also, in some embodiments it will be advantageous for the drainage volume to be vented to the outside so that the non-wetting coating can be applied to the internal surfaces after assembly.

Thus, it is believed that the combination of the geometry with the non-wetting coating tends to focus the repellent activity of the non-wetting coating, thus tending to divert fluid from module volume 130, having a higher percentage of coated surface area and/or a higher surface area to volume ratio, to drainage volume 134, having a lower percentage of coated surface area and/or a lower surface area to volume ratio. The invention is therefore believed to provide an effect which can operate to divert fluid from module volume 130 to drainage volume 134, in contrast to the 'capillary effect,' which typically draws fluid into small volumes.

Figure 2G:
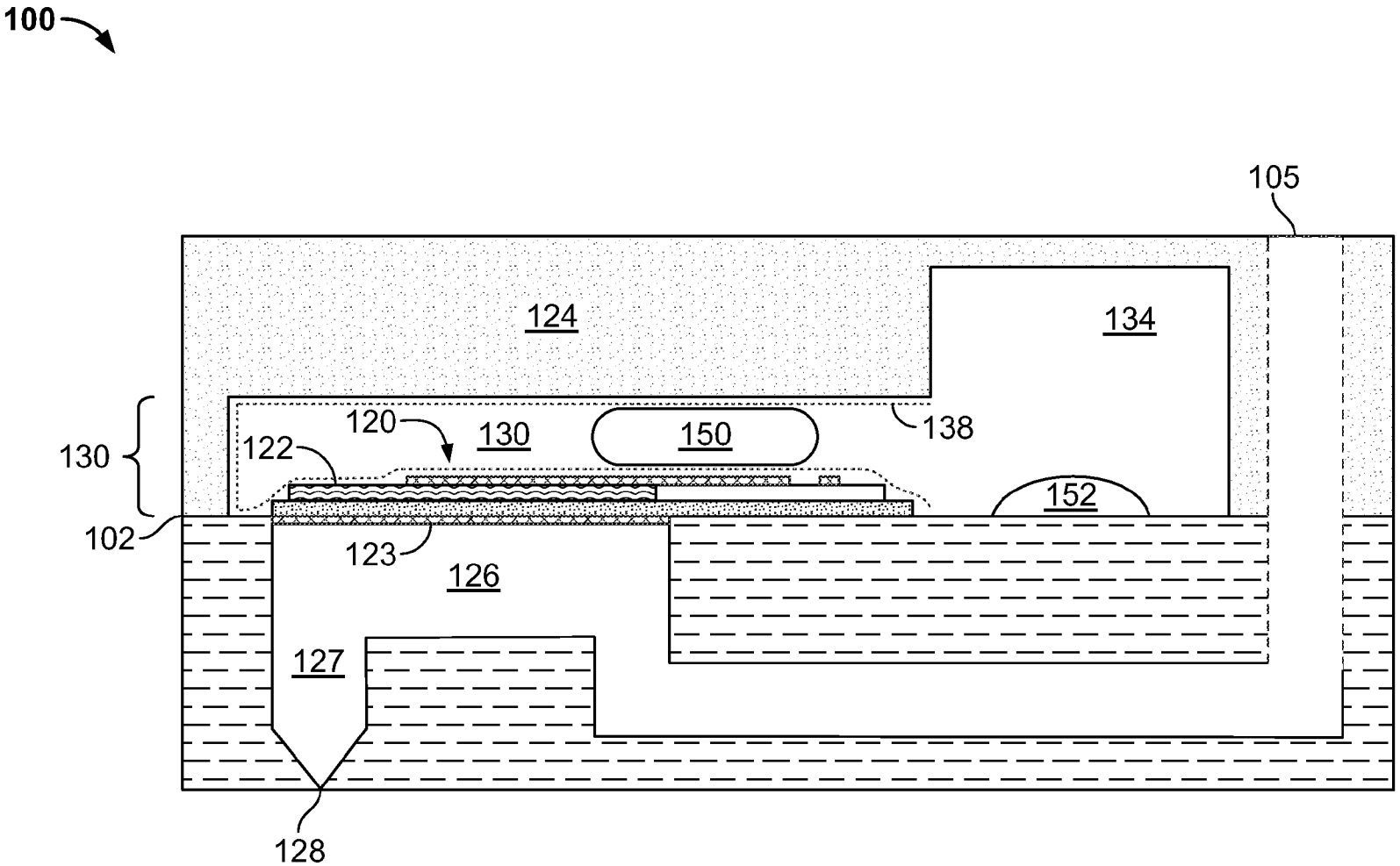
FIGS. 2G and 2H illustrate the effect of fluid ejector heads 100 and 100', respectively, on exemplary droplets of fluid in module volume 130 and drainage volume 134.
Figure 2H:
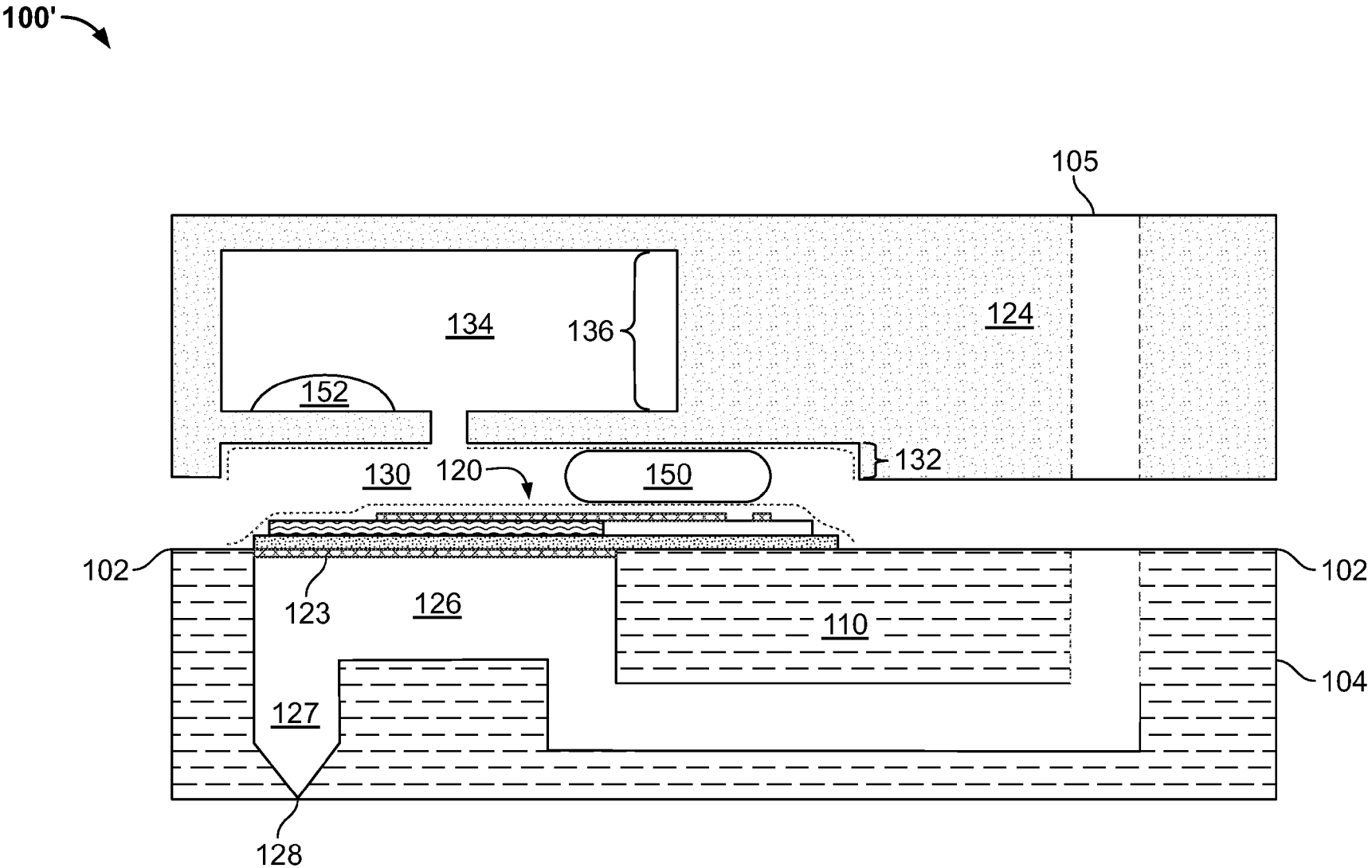

FIGS. 2G and 2H illustrate this effect for exemplary droplets of fluid in fluid ejector heads 100 and 100', respectively, where nonwetting coating 138 selectively applied to surfaces bordering module volume 130. A droplet of fluid 150 in volume 130 is depicted under significant forcing pressure according to the restricted dimension 132 and nonwetting coating 138 in module volume 130. By contrast, a droplet of fluid 152 in drainage volume 134 is relieved of such forcing pressure according to dimension 136 and lack of nonwetting coating 138 in drainage volume 134. Consequently, there is believed to be a driving force to direct fluid from module volume 130 to drainage volume 134.

A number of embodiments of the invention have been described. Nevertheless, it will be understood that various modifications may be made without departing from the spirit and scope of the invention. For example, the steps in the process 300 can be performed in a different order than shown and still achieve desired results. Accordingly, other embodiments are within the scope of the following claims.

What is claimed is:

1. A fluid ejector head, comprising:

a die with a plurality of fluid ejector units, each fluid ejector unit of the plurality of fluid ejector units comprising a pumping actuator having a drive electrode; and a manifold that contacts a first side of the die to define a module volume in fluidic communication with a drainage volume, the module volume defined in part between the manifold and at least a portion of plurality of fluid ejector units, the drainage volume being located apart from the fluid ejector units, wherein the module volume, in comparison to the drainage volume, has a greater ratio of interior surface area to volume or has a greater percentage of interior surface area covered by a non-wetting coating.

2. The fluid ejector head of claim 1, wherein the module volume, in comparison to the drainage volume, has both the greater interior surface area to volume ratio and the greater percentage of interior surface area covered by the non-wetting coating.

3. The fluid ejector head of claim 1, wherein an interior surface of the module volume is defined in part by a portion of the drive electrode or the pumping actuator.

4. The fluid ejector head of claim 1, wherein the non-wetting coating coats the drive electrode or the pumping actuator of each fluid ejector unit.

5. The fluid ejector head of claim 1, wherein the module volume is defined by at least one dimension that is substantially smaller than each dimension of the drainage volume.

6. The fluid ejector head of claim 5, wherein the manifold is separated from the fluid ejector units in the module volume by between about 1 and about 20 micrometers.

7. The fluid ejector head of claim 1, wherein the non-wetting coating coats an interior surface of the manifold at the module volume.

8. The fluid ejector head of claim 1, wherein the non-wetting coating coats interior surfaces of the module volume and the drainage volume.

9. The fluid ejector head of claim 1, wherein the drainage volume is substantially defined between the manifold and the first side of the die.

10. The fluid ejector head of claim 9, wherein the first side of the die at the drainage volume is coated with the non-wetting coating.

11. The fluid ejector head of claim 1, wherein the drainage volume is substantially defined within the manifold.

12. The fluid ejector head of claim 1, wherein each pumping actuator is a piezoelectric deflector, a thermal bubble jet generator, or an electrostatically deflected element.

13. The fluid ejector head of claim 12, wherein each pumping actuator is a piezoelectric deflector, whereby the fluid ejector head is a piezoelectric fluid ejector head.

14. The fluid ejector head of claim 1, wherein the non-wetting coating is a self assembled monolayer, a molecular aggregation, or a non-wetting layer bonded to a seed layer.

15. The fluid ejector head of claim 1, wherein the module volume and the drainage volume are hermetically open.

16. A method of diverting fluid from a fluid ejector module, comprising:

providing a die that includes a plurality of fluid ejector units, each fluid ejector unit of the plurality of fluid ejector units comprising a pumping actuator having a drive electrode;

providing a module volume in fluidic communication with a drainage volume, the module volume defined in part between a manifold and at least a portion of the fluid ejector units, the drainage volume being located apart from the fluid ejector units;

providing the module volume, in comparison to the drainage volume, with a greater ratio of interior surface area to volume, or with a greater percentage of interior surface area coated by a non-wetting coating; and diverting fluid from the module volume to the drainage volume.

17. The method of claim 16, wherein the module volume, in comparison to the drainage volume, has both the greater ratio of interior surface area to volume and has the greater percentage of interior surface area coated by a non-wetting coating.

18. The method of claim 16, wherein an interior surface of the module volume is defined in part by a portion of the drive electrode or the pumping actuator.

19. The method of claim 16, wherein the non-wetting coating coats the drive electrode or the pumping actuator of each fluid ejector unit.

20. The method of claim 16, wherein the module volume is defined by at least one dimension that is substantially smaller than each dimension of the drainage volume.

21. The method of claim 20, wherein the manifold is separated from the fluid ejector units in the module volume by between about 1 and about 20 micrometers.

22. The method of claim 16, wherein the drainage volume is substantially defined between the manifold and a first side of the die that contacts the manifold.

23. The method of claim 16, wherein the drainage volume is substantially defined within the manifold.

24. The method of claim 16, wherein each pumping actuator is a piezoelectric deflector, a thermal bubble jet generator, or an electrostatically deflected element.

25. The method of claim 24, wherein each pumping actuator is a piezoelectric deflector.

26. The method of claim 16, further comprising equalizing a pressure in the module volume and the drainage volume with ambient pressure.

27. The method of claim 20, wherein the non-wetting coating is a self assembled monolayer, a molecular aggregation, or a non-wetting layer bonded to a seed layer.

* * * * *